US010060144B1

(12) United States Patent
Francies, III

(10) Patent No.: US 10,060,144 B1
(45) Date of Patent: Aug. 28, 2018

(54) LIFTING AND LEVELING ASSEMBLY FOR PRECAST CONCRETE SLABS AND METHOD

(71) Applicant: MAESTRO INTERNATIONAL, LLC, Lithia, FL (US)

(72) Inventor: Sidney E. Francies, III, Lithia, FL (US)

(73) Assignee: MAESTRO INTERNATIONAL, LLC, Lithia, FL (US)

( * ) Notice: Subject to any disclaimer, the term of this patent is extended or adjusted under 35 U.S.C. 154(b) by 0 days.

(21) Appl. No.: 15/828,841

(22) Filed: Dec. 1, 2017

(51) Int. Cl.

| | |
|---|---|
| ***E04G 21/14*** | (2006.01) |
| ***E04B 1/41*** | (2006.01) |
| ***E04G 21/10*** | (2006.01) |
| ***E04G 21/18*** | (2006.01) |
| ***E04B 5/04*** | (2006.01) |

(52) U.S. Cl.
CPC ..... *E04G 21/10* (2013.01); *E04B 5/04* (2013.01); *E04G 21/1841* (2013.01); *E04B 2103/02* (2013.01)

(58) Field of Classification Search
CPC ..... E04C 23/10; E04C 19/52; E04G 21/1841; E04G 21/10; E04B 1/3511; E04B 2001/3588
See application file for complete search history.

(56) References Cited

U.S. PATENT DOCUMENTS

| | | | | |
|---|---|---|---|---|
| 2,075,714 | A | 3/1937 | Hamill | |
| 2,309,451 | A | 1/1943 | Corbett | |
| 2,952,947 | A | 9/1960 | White | |
| 2,954,647 | A | 10/1960 | Lee | |
| 3,095,672 | A | 7/1963 | Di Tullio | |
| 3,216,157 | A | 11/1965 | Pinter | |
| 3,298,272 | A | 1/1967 | Henderson | |
| 3,431,012 | A * | 3/1969 | Eriksson | B28B 23/005 294/89 |
| 3,590,538 | A * | 7/1971 | Holt | E04B 1/4121 52/127.3 |
| 3,640,328 | A | 2/1972 | Tummarello | |
| 3,715,851 | A | 2/1973 | Bennett | |
| 4,000,591 | A * | 1/1977 | Courtois | B28B 23/005 52/125.4 |
| 4,325,575 | A | 4/1982 | Holt | |
| 4,437,276 | A | 3/1984 | Goldberg | |
| 5,257,490 | A | 11/1993 | Endo | |
| 6,558,071 | B1 * | 5/2003 | Sproules | E01C 5/08 404/78 |
| 8,875,471 | B2 | 11/2014 | Siqueiros | |
| 9,347,232 | B1 * | 5/2016 | Francies, III | E04G 21/142 |
| 2012/0227335 | A1 | 9/2012 | Francies, III | |
| 2013/0067849 | A1 * | 3/2013 | Espinosa | E04B 1/4121 52/699 |

(Continued)

*Primary Examiner* — Christine T Cajilig
(74) *Attorney, Agent, or Firm* — McGarry Bair PC

(57) ABSTRACT

A lifting and leveling assembly is configured to be embedded in a precast concrete slab for enabling a precast concrete slab to be lifted and leveled. The lifting and leveling assembly includes a threaded sleeve having a first end and a second end, a plurality of legs fixedly attached to and extending from the threaded sleeve, an end cap selectively covering the first end of the threaded sleeve, and a plate cover comprising an annular collar for releasably connecting the second end of the threaded sleeve to the plate cover.

21 Claims, 9 Drawing Sheets

(56) References Cited

U.S. PATENT DOCUMENTS

| | | | | |
|---|---|---|---|---|
| 2014/0026515 | A1* | 1/2014 | Espinosa | E04B 1/4171 52/700 |
| 2014/0053475 | A1* | 2/2014 | Siqueiros | E01C 23/10 52/125.1 |
| 2014/0150356 | A1* | 6/2014 | Reed | E04B 1/4114 52/126.7 |
| 2015/0096242 | A1* | 4/2015 | Lin | E04G 15/04 52/125.5 |
| 2016/0138280 | A1* | 5/2016 | Lutes | E04F 21/241 33/533 |
| 2017/0226702 | A1* | 8/2017 | Connell | E01C 5/00 |
| 2018/0023296 | A1* | 1/2018 | Recker | E04B 5/02 |

* cited by examiner

LIFTING AND LEVELING ASSEMBLY FOR PRECAST CONCRETE SLABS AND METHOD

BACKGROUND OF THE DISCLOSURE

Precast concrete slabs are commonly used in the construction and repair of concrete surfaces such as concrete roads. Precast concrete slabs are lifted and placed in excavations and then leveled to be even with adjacent slabs. The slabs are leveled using precise surveys and excavation, plastic leveling shims, grout leveling pads or a process known as "mud jacking"; however, these leveling techniques can be costly and time consuming.

SUMMARY OF THE DISCLOSURE

One embodiment of the disclosure is a lifting and leveling assembly configured to be embedded in a precast concrete slab for enabling a precast concrete slab to be lifted and leveled. The lifting and leveling assembly comprises a threaded sleeve having a first end and a second end, a plurality of legs fixedly attached to and extending from the threaded sleeve, an end cap selectively covering the first end of the threaded sleeve, a plate cover comprising an annular collar with a peripheral wall, and at least one clip disposed on the peripheral wall of the annular collar for releasably connecting the second end of the threaded sleeve to the plate cover.

Another embodiment of the disclosure is a lifting and leveling assembly configured to be embedded in a precast concrete slab for enabling a precast concrete slab to be lifted and leveled. The lifting and leveling assembly comprises a threaded sleeve having a first end and a second end, a plurality of legs fixedly attached to and extending from the threaded sleeve, an end cap selectively covering the first end of the threaded sleeve and a plate cover comprising an annular threaded collar for threadably connecting the second end of the threaded sleeve to the plate cover.

DETAILED DESCRIPTION

Figure 1:
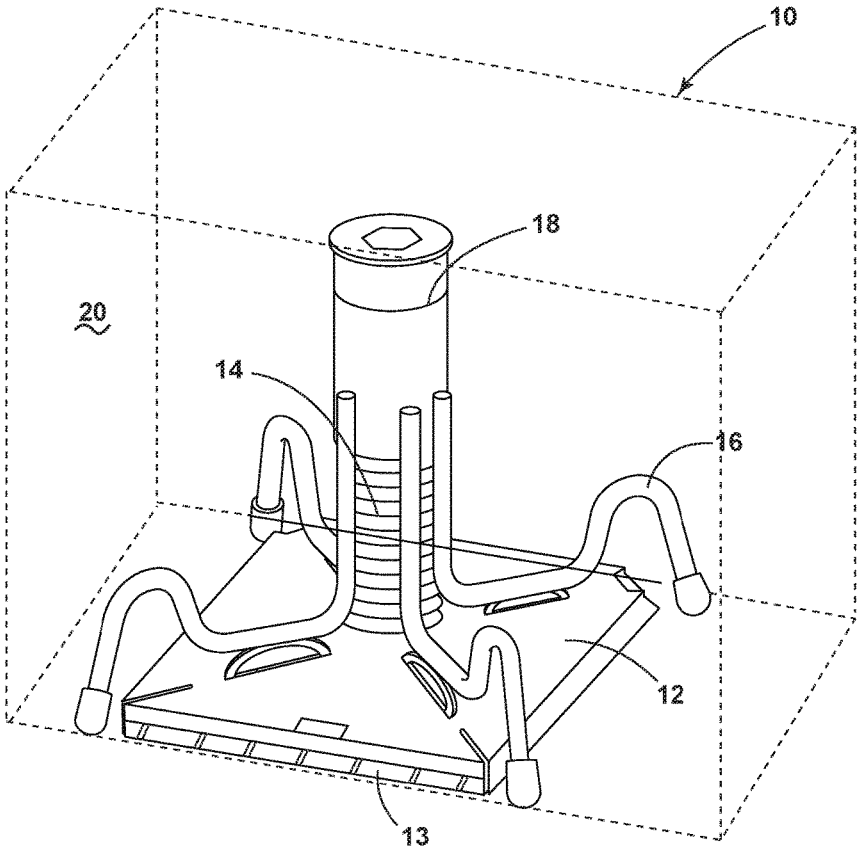
FIG. 1 is a top perspective view of a lifting and leveling assembly according to the present disclosure.

Turning now to the drawings and in particular to FIG. 1, there is shown a top perspective view of a lifting and leveling assembly 10 according to an embodiment of the present disclosure. The leveling and lifting assembly 10 comprises a plate cover 12, a sleeve 14 with support legs 16, and an end cap 18. The lifting and leveling assembly 10 can be cast in a concrete slab 20. The lifting and leveling assembly 10 can be positioned so that the bottom surface of the plate cover 12 covers a leveling plate 13 that is flush with the bottom surface of the precast concrete slab 20 and the top surface of the end cap 18 can be slightly below or substantially flush with the top surface of the precast concrete slab 20. Typically at least four leveling and lifting assemblies 10 are embedded into concrete slabs, one at each corner. After casting and curing, the assembly 10 can be used to lift and level sections of precast concrete.

Figure 2:
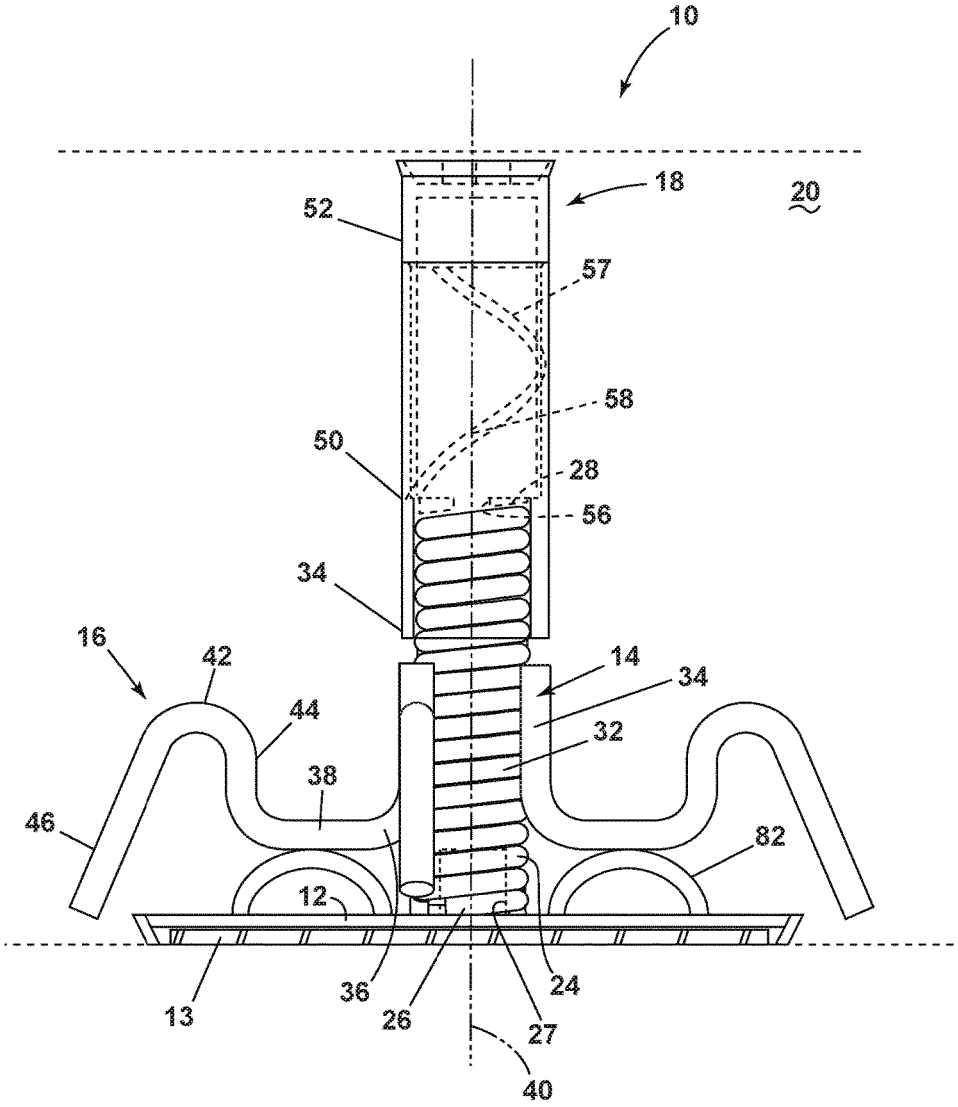
FIG. 2 is a side view of the lifting and leveling assembly of FIG. 1 cast in concrete.

FIG. 2 illustrates a side view of the lifting and leveling assembly 10 cast in a concrete slab 20. The plate cover 12 of the lifting and leveling assembly 10 can generally be made in a quadrilateral shape such as a square or rectangular configuration and can be made from high strength thermoplastic or metal and dimensioned to compliment the slab size and thickness. The plate cover 12 is configured to cover and encapsulate a leveling plate 13 and provide a stable base or foundation for the lifting and leveling assembly 10. The plate cover 12 can be of various sizes or shapes, but in an exemplary embodiment the plate cover 12 is generally slightly larger than 6 in×6 in×¼ in thick, the typical size of a leveling plate 13.

The sleeve 14 of the lifting and leveling assembly 10 can be in the form of a hollow cylinder or annular housing located equidistant around axis of symmetry 40. As illustrated, the sleeve 14 can comprise an annularly wrapped coil 24 defining an outer surface 32. The wrapped coil 24 can also form an aperture or channel 26, which forms an inner surface 27. The coil 24 can have various dimensions, but in an exemplary embodiment, the wrapped coil 24 is 1" in diameter and formed from high strength steel or welded together from separate pieces or made from high strength thermoset plastics or thermoplastics. In addition, it should be recognized that while it is contemplated the sleeve can be formed from wrapped coil 24, the sleeve 14 could also be formed from other high strength materials and metals capable for being formed into a hollow cylinder without departing from the scope of the disclosure.

The inner surface wall 27 can be threaded to engage with a lifting bolt (not shown). In one example, the wrapped coil 24 can have a pitch that defines threaded grooves. The lifting bolt could have threads that complement the wrapped coil threaded grooves, thereby allowing the lifting bolt to be screwed or unscrewed through the channel 26 in the sleeve 14. Moreover, if the sleeve is formed from a material other than wrapped coil 24, threaded grooves or threads could be molded or formed on the inner surface 27 of the channel 26. In either case, the lifting bolt can be made from high strength steel by methods well known in the art and dimensioned to compliment the slab thickness. Additionally, the lifting bolt can be formed with a hexagon or square head to compliment a variety of well-known socket wrenches and square drivers, respectively.

The threaded sleeve 14 can have one or more legs 16 comprised of high strength steel securely fixed or welded to the outer surface 32 of the threaded sleeve 14. As illustrated, each leg 16 can comprise an elongated attachment portion 34 that is generally parallel with the axis of symmetry 40. The elongated attachment portion 34 can have a length along a portion of the sleeve 14, which provides a contact surface area for securely attaching or welding the leg 16 to the threaded sleeve 14. In the illustration, the elongated attachment portion 34 is welded to the sleeve 14. The elongated attachment portion 34 transitions via elbow 36 to an extension portion 38 that generally runs orthogonal to the axis of symmetry 40 and parallel to plate cover 12. The extension portion 38 of the leg 16 can have a length across a portion of the plate cover 12 before transitioning to end leg portion 42. The end leg portion 42 can comprise an upside down general "U shaped" curve having one appendage 44 that extends generally parallel to the axis of symmetry 40 and the other appendage 46 transitioning at about a 30-45 degree angle to the axis of symmetry 40 down toward the plate cover 12. The appendages 44, 46 of the leg portion 42 can be at a variety of angles with respect to the axis of symmetry 40 without departing from the scope of the disclosure.

An end cap 18 can be provided to overlap or cover an open end 28 of the sleeve 14. In an exemplary embodiment, the end cap 18 overlaps the open end 28 of the sleeve 14 by at least 1 inch to allow the end cap 18 to be sufficiently supported by the sleeve 14. The end cap 18 can be made from thermoset plastics or thermoplastics and can be formed through methods well known in the art such as injection molding. The end cap 18 can comprise a base portion 50 and an upper telescoping portion 52. The base portion 50 can be configured to allow the upper telescoping portion 52 of the end cap 18 to be adjustable in height so as to accommodate concrete slabs having different thicknesses and be removable from the assembly 10 after the assembly 10 has been cast in the concrete 20.

The upper telescoping portion 52 of the end cap 18 can be sized to fit in the base portion 50 and can have a shape complementary to the base portion 50 to allow the upper telescoping portion 52 to slideably engage within base portion 50. The upper telescoping portion 52 can comprise a thread 57 to allow for screwing or un-screwing the upper telescoping portion 52 from the base portion 50.

Figure 3:
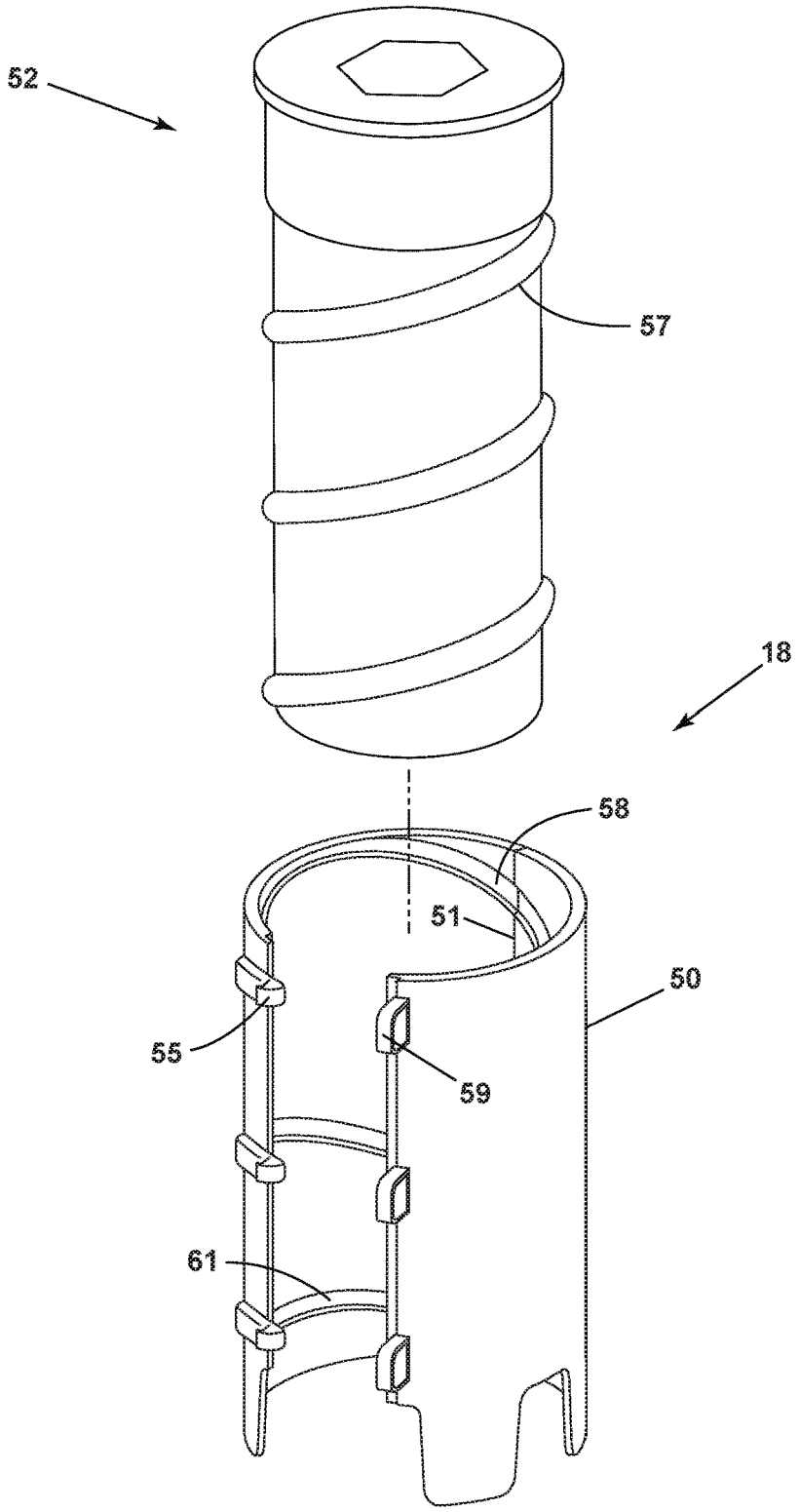
FIG. 3 is a perspective view of an end-cap in accordance with the present invention.

FIG. 3 depicts an exemplary base portion 50 of the end cap 18. The base portion 50 of the end cap 18 can be an annular cylinder configured to be screwed on to or hinged over at least a portion of the open end 28 of the sleeve 14. The base portion 50 can comprise two halves connected by hinge 51. The two halves can form an annular cylinder configured to wrap around and encompass the open end 28 of the sleeve 14. One half of the base portion 50 can comprise hooks 55 and the other can comprise clasps 59 for the hooks 55 to engage to close the base portion 50 around the sleeve 14. In addition, the base portion 50 can comprise an inner annular stop 61 configured to rest on sleeve 14 when the base portion 50 is connected around or screwed onto the sleeve 14.

The inner surface of the base portion 50 of the end cap 18 can comprise a groove 58 complementary in shape to thread 57 to allow for screwing or un-screwing the top cap 18 from the base portion 50. It is contemplated that the thread and complimentary groove comprise a single 360 degree loop around the periphery of the caps to allow for a single 360 degree twist of the end cap 18 to remove it from the base portion 50.

Figure 4:
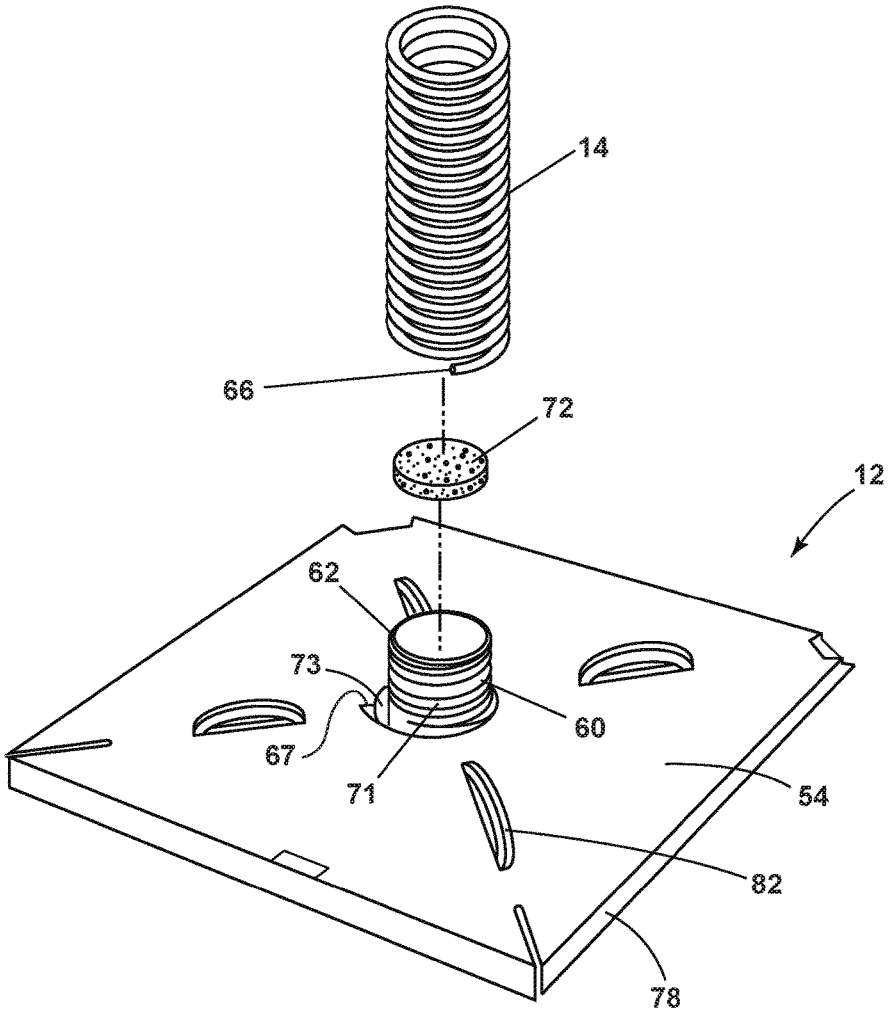
FIG. 4 is a top perspective view of one embodiment of a plate cover in accordance with the present disclosure.
Figure 5:
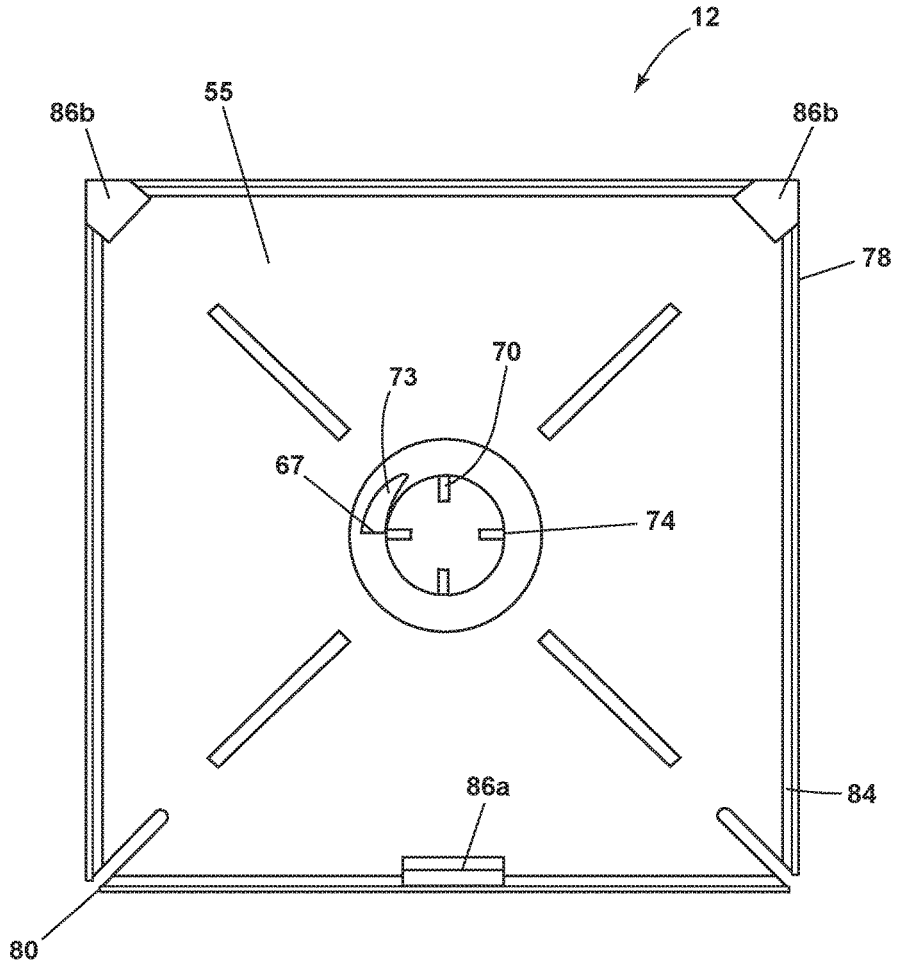
FIG. 5 is a bottom perspective view of the plate cover of FIG. 4.

FIGS. 4 and 5 illustrate one example of the plate cover 12 in more detail. The plate cover 12 can comprise a generally cylindrical threaded annular collar 60 that securely connects to the first end 29 of the sleeve 14. The threaded annular collar 60 has a peripheral wall 62 that extends axially from the plate cover top surface 54 around the circumference of the collar 60. The threaded annular collar 60 can have threads 71 that are complementary to the threads/grooves located on the inner wall 27 of the threaded wrapped coil 24 of the sleeve 14. Accordingly, the threaded sleeve 14 can be screwed onto the threaded annular collar 60 such that the threaded sleeve 14 engages and surrounds the threaded annular collar 60. It should be understood that while a threaded annular collar 60 is shown connecting the plate cover 12 to a first end 29 of the sleeve 14, this connection can be done by other attachment mechanisms such as snaps, nails, screws, bolts, adhesives, welds or rivets without departing from the scope of the disclosure.

The plate cover 12 can also comprise a tear-drop shaped aperture 73. The end 66 of the wrapped coil 24 can abut stop 67 located in aperture 73 when the coil 24 is placed or screwed on the annular collar 60. A portion of the wrapped coil 24 can extend into tear-dropped shaped aperture 73 when the end 66 of the wrapped coil 24 abuts stop 67. As the wrapped coil 24 winds up at a pitch, the threads 71 engage the threads/grooves located on the inner wall 27 of the threaded coil 24 to hold the threaded sleeve 14 in place. The threaded annular collar 60 can also be configured to be breakable or shearable at the base of the threaded annular collar 60.

The threaded annular collar 60 can further comprise one or more foam support brackets 70 (best shown in FIG. 5) located on an inner circumference of the annular collar 60. The foam support brackets 70 can be provided to support a foam plug 72 for preventing leakage into the assembly 10 when the assembly 10 is cast in concrete 20. The foam support brackets 70 can be integrally formed with the annular collar 60 and can take on any shape capable of supporting a foam plug, such as a triangular shape as illustrated. The foam support brackets 70 can be configured to be breakable at the intersection 74 between the threaded annular collar 60 and the base of the foam support bracket 70.

Additionally, the plate cover 12 can comprise one or more grippers 82 positioned around the top surface 54 of the plate cover 12. The grippers 82 can be of any number and shape that allows cement to flow around during the casting and curing process to hold the plate cover securely in the cement after casting. Here, the grippers 82 are shown as open arches and it is contemplated that four grippers 82 will be equidistantly spaced around the top surface 54 of the plate cover 12.

FIG. 5 illustrates the bottom or underside of plate cover 12. The plate cover 12 can comprise a front plate support **86*a*, one or more corner plate supports 86*b* for engaging and holding a leveling plate 13, and an arched spring 56. When inserting the leveling plate 13 into the plate cover 12, the corners are first inserted into corner plate supports 86*b*, which compresses arched spring 56 against the side of the leveling plate 13. The arched spring 56 puts a spring force on the leveling plate 13 causing the plate 13 to be push forward so the front of the plate 13 can be supported by front clip 86*b*. In this way, a leveling plate 13 can be inserted into and releasable carried by plate cover 12. As should be recognized, the plate cover 12 can be made from a hard plastic or metal and the arched spring 56 from a deformable or spring like material. In an another embodiment, the plate cover 12 could be formed of a flexible/deformable material such as a hard rubber or a deformable plastic to allow the front plate support 86*a* the flexibility to snap around the leveling plate 13 after the back corners of the plate are inserted in the corner plate supports 86*b***.

While it is contemplated to use multiple plate supports **86*a*, 86*b* to releasably hold the leveling plate 13 to the plate cover 12, there are many ways to achieve holding a leveling plate in place without departing from the scope of the disclosure. For example, in addition to or in lieu of plate supports 86*a*, 86*b*, the plate cover 12 could comprise beveled sidewalls 78 that slightly angle in relative to bottom surface 55. The upper edge of the beveled sidewalls 78 could comprise an engagement lip 84 configured to help engage and hold a leveling plate 13. Once again, in this embodiment, the plate cover 12 could be formed of a flexible/deformable material to allow the beveled sidewalls 78 and engagement lip 84 to grip and releasably hold a leveling plate 13. In addition, slots 80 can be provided around portions of the plate cover 12 to provide additional flexibility to the plate cover 12**.

Figure 6:
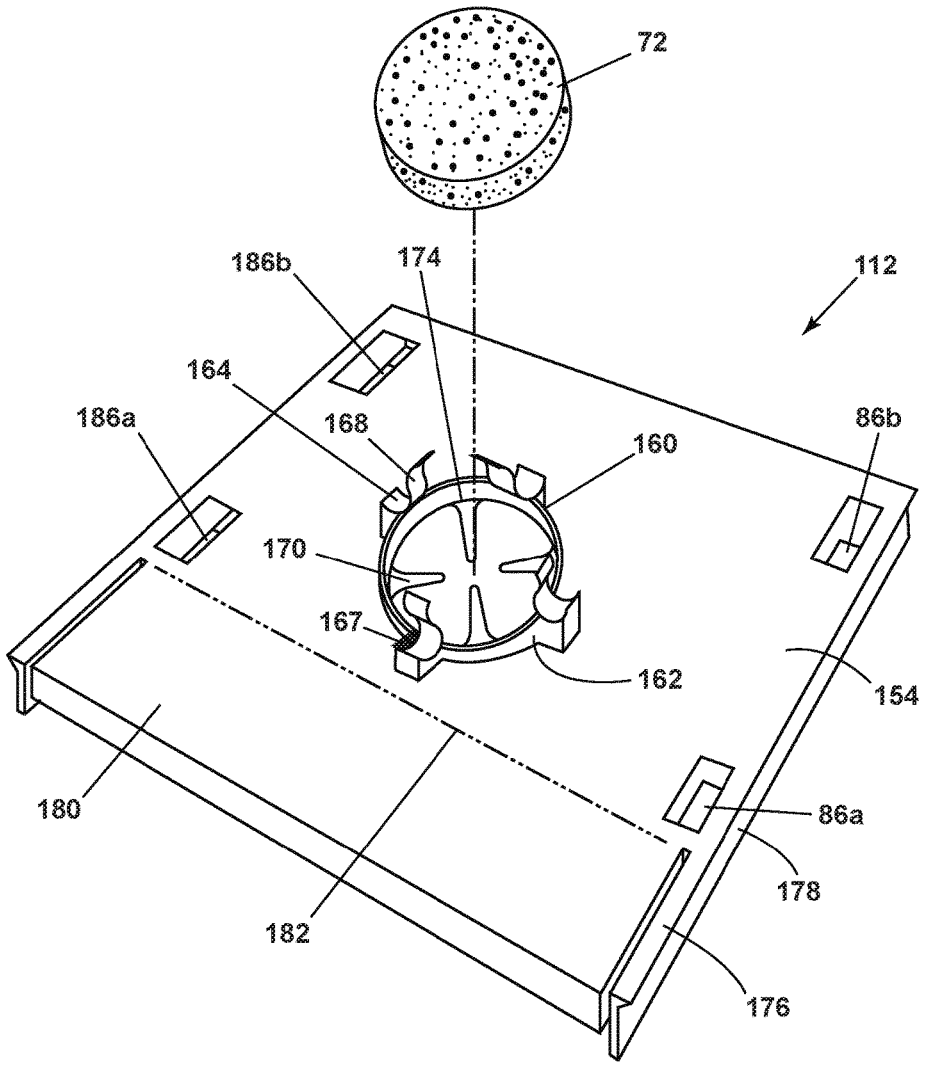
FIG. 6 is a top perspective view of one embodiment of a plate cover in accordance with the present disclosure.
Figure 7:
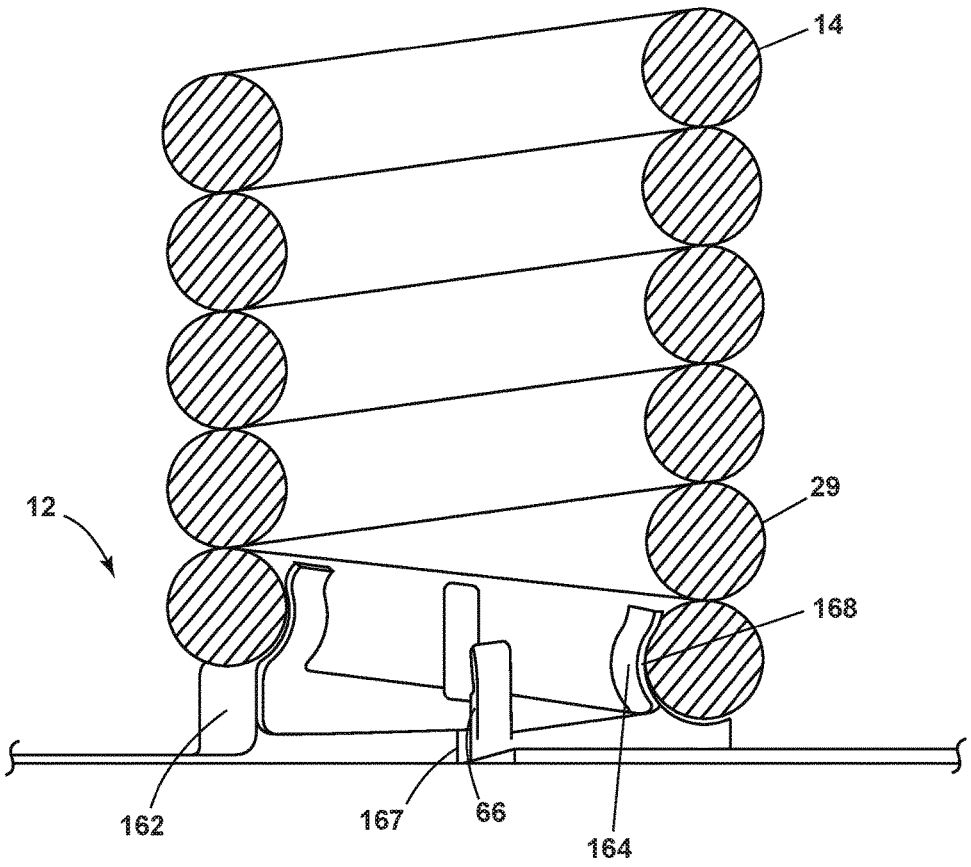
FIG. 7 is a close up side view the plate cover of FIG. 6 showing the connection between the plate cover and an annular sleeve.

FIG. 6 illustrates an alternate embodiment of the plate cover 112. The cover plate 112 is similar in function to the cover plate 12 as previously described, thus, like parts will be identified with like numerals increased by 100. In this embodiment, the plate cover 112 can also comprise a generally cylindrical collar 160 that securely connects to the first end 29 of the sleeve 14. The collar 160 has a peripheral wall 162 that extends axially from the plate cover top surface 154 around the circumference of the collar 160. One or more engagement clips 164 can be provided on the peripheral wall 162 of the collar 160 for snap fitting or engaging the first end 29 of the sleeve 14.

As illustrated, four clips 164 are integrally formed with and provided equidistant about the peripheral wall 162 of the collar 160. Each engagement clip 164 can have a raised lip 168 formed from a deformable plastic or metal that allows the clip 164 to snap engage the inner wall 27 of the sleeve 14. In the exemplary embodiment, the raised lip 168 of engagement clips 164 has a curved shaped to complement the curvature of the wrapped coil 24. More specifically, wrapped coil 24 begins at end 66, which abuts stop 167 and annularly wraps and increases in height. As the wrapped coil 24 winds up at a pitch, each engagement clip 164 increases in height to accommodate for the winding of the wrapped coil 24. As a result, each of the engagement clips 164 around the periphery is configured to engage a portion of the wrapped coil 24 and can exert an opposing force on that portion of wrapped coil 24 thereby holding the sleeve 14 in place.

Similar to the embodiment shown in FIG. 4-5, the annular collar 160 can further comprise one or more foam support brackets 170 located on an inner circumference of the annular collar 160. The foam support brackets 170 can be provided to support a foam plug 72 for preventing leakage into the assembly 10 when the assembly 10 is cast in concrete 20. The foam support brackets 170 can be integrally formed with the annular collar 160 and can take on any shape capable of supporting a foam plug, such as a triangular shape as illustrated. The foam support brackets 172 can be configured to be breakable at the intersection 174 between the annular collar 160 and the base of the foam support bracket 170.

The plate cover 112 can further comprise a chamfer 176 positioned around one or more side edges 178 of plate cover 112. The chamfer 176 provides a lip for concrete to cure thereby ensuring the plate cover 112 stays securely fixed or embedded in the concrete after the concrete has cured around the assembly 10.

The plate cover 112 can also comprise a hinged cover 180 being hinged across a portion of the plate cover as indicated by hinge line 182. The hinge line 182 can be located across a portion of the plate cover 112 to allow access to the underside of the plate cover 112, where one or more plate supports 186*a*, 186*b* are located. The plate supports 186*a*, 186*b* are configured to provide support for a leveling plate 13. The hinge cover 180 can be opened or hinged back thereby allowing a leveling plate 13 to be inserted through to the first set of plate supports 186*a*. The leveling plate 13 can then be tilted and further inserted to back of the plate cover 112 and supported by plate supporters 186*a*, 186*b*. Once the leveling plate 13 is fully inserted, the hinge cover 180 can be returned to its original closed position. As will be explained, the plate supports 186*a*, 186*b* are configured to be breakable or bendable so as to selectively allow the leveling plate 13 to be separated from the plate cover 12.

Figure 8:
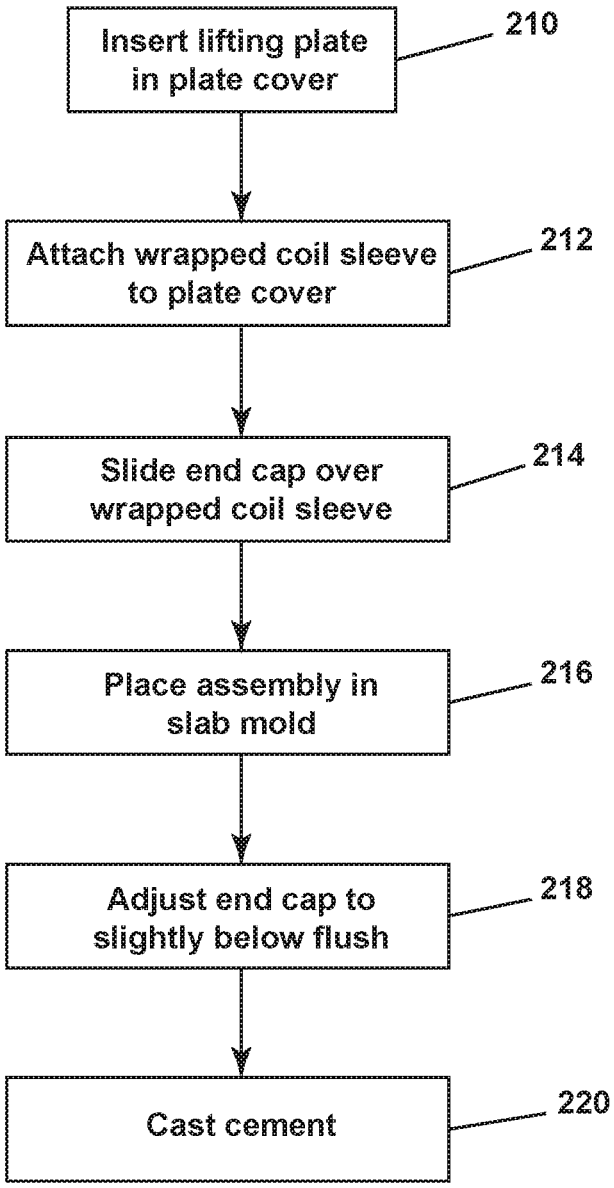
FIG. 8 is a flowchart of the steps associated with casting a lifting and leveling assembly in a concrete slab.

Turning to FIG. 8, there is shown a flowchart of method 200 of installing a precast concrete slab using a lifting and leveling assembly according to an embodiment of the disclosure. First, step 210, a leveling plate is inserted into the plate cover and supported by the plate support brackets of FIG. 4. Once inserted the sleeve is attached to the cover plate, shown as step 212. The end cap is then wrapped around or slid over the sleeve as denoted in step 214. One or more of the leveling and lifting assemblies 10 are then placed into a slab mold at step 216, wherein the lower surface of the leveling plate and cover plate are positioned on a bottom surface of the mold. In step 218, the upper portion of the end cap is positioned so it slightly below or flush with what will be the top of the poured cement. Cement is then poured at step 220 into the mold and the cement is cured, thus embedding the leveling and lifting assemblies into the concrete slab. After casting and curing, the slab is placed into storage or onto transportation for installation at a site.

Figure 9:
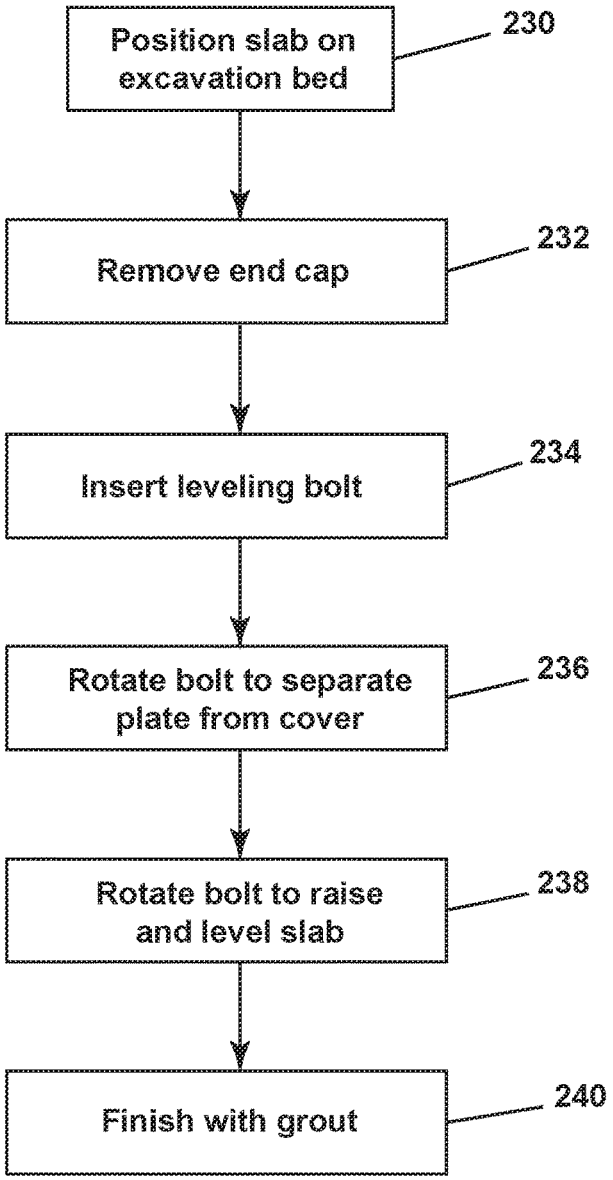
FIG. 9 is a flowchart of the steps associated with leveling a concrete slab using the lifting and leveling assembly of the present disclosure.

FIG. 9 illustrates the installation steps once at the installation site. First, the slab can be lifted and positioned in the excavation or road bed, shown as step 230. Once positioned in the excavation, the precast concrete can be raised and leveled. To raise and level the slab, the end cap is removed at step 232 exposing the sleeve and the internal threaded channel in the sleeve. A lifting bolt can be inserted in the threaded channel at step 234 and rotated clockwise by using a conventional socket wrench or other tool configured to drive the lifting bolt. Rotating the lifting bolt clockwise drives the lifting bolt toward the leveling plate so that the bottom surface of the threaded bolt contacts the top surface of the leveling plate. Continued rotation of the axially supported lifting bolt causes the plate supports of FIG. 4 to break and separate the leveling plate from the plate cover as denoted at step 236.

Continuing further rotation of the lifting bolt drives the lifting bolt against the leveling plate, which directs an upward reaction force on the slab on the precast concrete slab, thus raising the precast concrete slab at step 238. In this way the level of the precast concrete slab relative to the excavation bed can be adjusted so as to be level with adjacent slabs. It will be understood that common precast concrete slabs are rectangular in shape and to level properly, a lifting an leveling assembly may be disposed at or near each corner of the precast concrete slab so as to raise and level each corner of the precast concrete slab. It will also be understood that an excavation bed may be any surface on which the precast concrete slab is to be placed upon. Once the desired level is achieved, a suitable grout may be pumped on top and beneath the precast concrete slab to fill and solidify the void between the excavation bed and the precast concrete slab at step 240.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A lifting and leveling assembly configured to be embedded in a precast concrete slab for enabling a precast concrete slab to be lifted and leveled, the lifting and leveling assembly comprising:

a sleeve having a first end and a second end;

a plurality of legs fixedly attached to and extending from the sleeve;

an end cap selectively covering the first end of the sleeve;

a plate cover comprising an annular collar having a peripheral wall; and a plurality of clips disposed on the peripheral wall of the annular collar for releasably connecting the second end of the sleeve to the plate cover, wherein the plurality of clips snap engage an inner wall of the sleeve, and wherein each clip extends from the plate cover a different height.

2. The lifting and leveling assembly of claim 1 wherein the plurality of clips are configured to be breakable.

3. The lifting and leveling assembly of claim 1 further comprising a foam plug configured to fit in the annular collar.

4. The lifting and leveling assembly of claim 3 further comprising foam support brackets located on an inner circumference of the annular collar for supporting the foam plug.

5. The lifting and leveling assembly of claim 1 wherein the plate cover is a quadrilateral shape.

6. The lifting and leveling assembly of claim 5 further comprising a chamfer on at least one edge of the plate cover.

7. The lifting and leveling assembly of claim 1 wherein the end cap slidably mounts over the first end of the sleeve.

8. The lifting and leveling assembly of claim 7 wherein the end cap is height adjustable to adjust an overall height the lifting and leveling assembly defined by the height between the plate cover and a top surface of the end cap.

9. The lifting and leveling assembly of claim 8 wherein the end cap comprises an annular thread configured to allow the end cap to be adjustable and removable from the lifting and leveling assembly.

10. A lifting and leveling assembly configured to be embedded in a precast concrete slab for enabling a precast concrete slab to be lifted and leveled, the lifting and leveling assembly comprising: a threaded sleeve comprising an annularly wrapped coil having a first end and a second end; the annularly wrapped coil forming a channel with female threads on an inner wall; a plurality of legs fixedly attached to and extending from the threaded sleeve; an end cap selectively covering the first end of the threaded sleeve; a plate cover comprising an annular threaded collar for threadably connecting the second end of the threaded sleeve to the plate cover; the inner wall of the annularly wrapped coil configured to wrap around and threadingly engage with complementary male threads on the threaded annular collar and a foam plug configured to fit in the annular collar.

11. The lifting and leveling assembly of claim 10 wherein the plate cover further comprises one or more grippers.

12. The lifting and leveling assembly of claim 10 wherein the plate cover comprises rubberized plastic.

13. The lifting and leveling assembly of claim 10 wherein the plate cover further comprises an aperture adjacent the annular threaded collar.

14. The lifting and leveling assembly of claim 11 wherein the plate cover further comprises a stop for abutting an end of the threaded sleeve.

15. The lifting and leveling assembly of claim 10 wherein the annular threaded collar is configure to be shearable from the cover plate.

16. The lifting and leveling assembly of claim 10 further comprising foam support brackets located on an inner circumference of the annular collar for supporting the foam plug.

17. A lifting and leveling assembly configured to be embedded in a precast concrete slab for enabling a precast concrete slab to be lifted and leveled, the lifting and leveling assembly comprising:

a sleeve having a first end and a second end;

a plurality of legs fixedly attached to and extending from the sleeve;

an end cap selectively covering the first end of the sleeve;

a plate cover comprising an annular collar having a peripheral wall;

a foam plug configured to fit in the annular collar; and at least one clip disposed on the peripheral wall of the annular collar for releasably connecting the second end of the sleeve to the plate cover.

18. The lifting and leveling assembly of claim 17 further comprising foam support brackets located on an inner circumference of the annular collar for supporting the foam plug.

19. The lifting and leveling assembly of claim 17 wherein the end cap slidably mounts over the first end of the sleeve and is height adjustable to adjust an overall height the lifting and leveling assembly defined by the height between the plate cover and a top surface of the end cap.

20. A lifting and leveling assembly configured to be embedded in a precast concrete slab for enabling a precast concrete slab to be lifted and leveled, the lifting and leveling assembly comprising:

a threaded sleeve having a first end and a second end;

a plurality of legs fixedly attached to and extending from the threaded sleeve;

an end cap selectively covering the first end of the threaded sleeve;

a plate cover comprising an annular threaded collar for threadably connecting the second end of the threaded sleeve to the plate cover; and a foam plug configured to fit in the annular collar.

21. The lifting and leveling assembly of claim 20 further comprising foam support brackets located on an inner circumference of the annular collar for supporting the foam plug.

* * * * *